US005164538A

United States Patent [19]

McClain III, Harry T.

[11] Patent Number: 5,164,538

[45] Date of Patent: Nov. 17, 1992

[54] PROJECTILE HAVING PLURAL ROTATABLE SECTIONS WITH AERODYNAMIC AIR FOIL SURFACES

[75] Inventor: McClain III, Harry T., Riviera, Ariz.

[73] Assignee: Twenty-First Century Research Institute, San Antonio, Tex.

[21] Appl. No.: 662,402

[22] Filed: Feb. 28, 1991

Related U.S. Application Data

[60] Division of Ser. No. 342,632, Apr. 20, 1989, Pat. No. 4,996,924, which is a continuation of Ser. No. 84,289, Aug. 11, 1987, abandoned, which is a continuation-in-part of Ser. No. 829,946, Feb. 18, 1986, abandoned.

[51] Int. Cl.[5] ..... F42B 10/00; F42B 12/00

[52] U.S. Cl. ..... 102/517; 102/501; 102/511; 244/3.23

[58] Field of Search ..... 244/3.23; 102/374, 439, 102/501, 503, 511, 517, 473

[56] References Cited

U.S. PATENT DOCUMENTS

| | | | |
|---|---|---|---|
| 33,378 | 10/1861 | Brown | 244/3.23 |
| 760,338 | 5/1904 | Kwiatkowski | 102/501 |
| 871,825 | 11/1907 | Schupmann | 102/501 |
| 2,787,958 | 4/1957 | Brandt | 244/3.23 |
| 3,251,267 | 5/1966 | Hauser et al. | 244/3.23 |
| 3,942,443 | 3/1976 | Lyles | 102/374 |

FOREIGN PATENT DOCUMENTS

| | | | |
|---|---|---|---|
| 4937 | of 1915 | United Kingdom | 102/503 |

*Primary Examiner*—Harold J. Tudor
*Attorney, Agent, or Firm*—Robert E. Harris

[57] ABSTRACT

Aerodynamical air foil surface and subsurface expressions and/or impressions of varied geometrics, angles of attack, heights and depths, comprising part of a projectile surface itself to create McClain effect molecular friction/pressure/temperature reaction flight control surfaces which automatically achieve in all fluids and velocities of flight self-stabilizing spin and rotation, increased height of trajectory with corresponding enhancement of range and distance, kinetic energies, inducing smooth laminar boundary layer flows, substantially decreasing drag effects, synergistically combined to constitute a major technological improvement in performance of all projectiles. Projectile having plurality rotatable sections with aerodynamic air foil surfaces provides self-stabilized spin projectile with sections rotating in opposite directions.

12 Claims, 2 Drawing Sheets

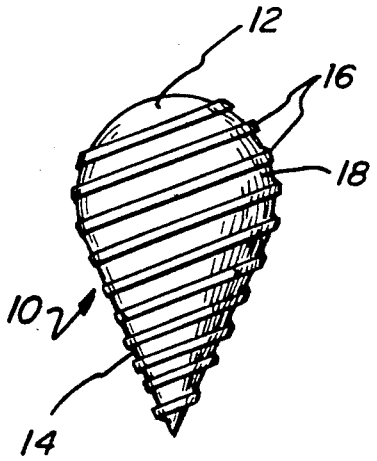
Fig_1
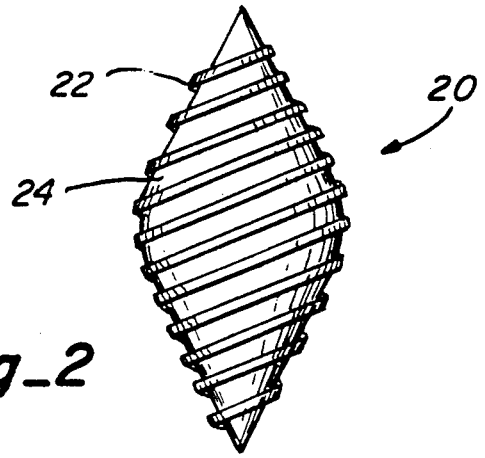
Fig_2
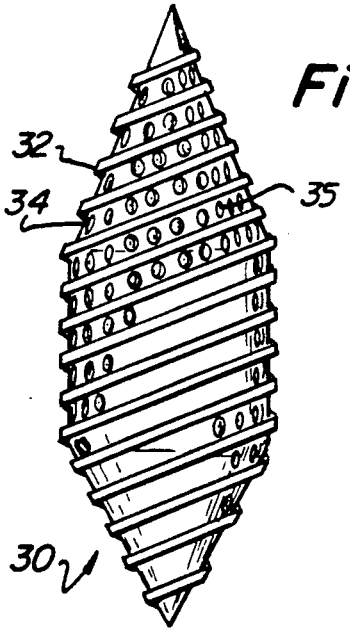
Fig_3
Fig_4A
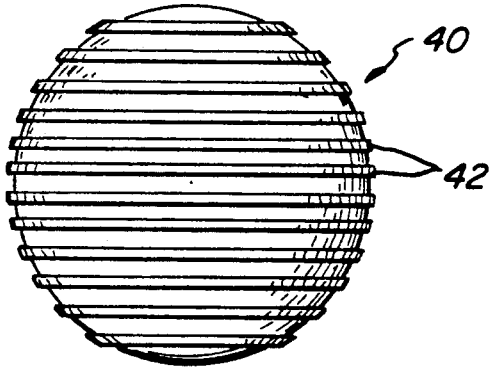
Fig_4B
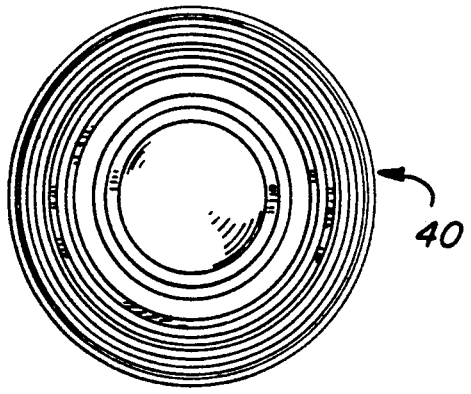
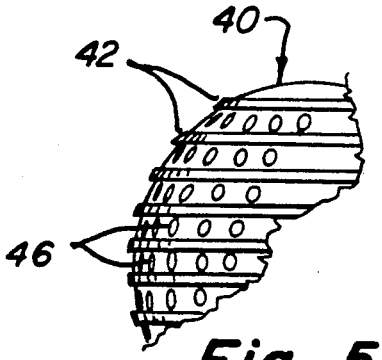
Fig_5

PROJECTILE HAVING PLURAL ROTATABLE SECTIONS WITH AERODYNAMIC AIR FOIL SURFACES

RELATED APPLICATION

This Application is a division of U.S. patent application Ser. No. 07/342,632, filed Apr. 20, 1989, now U.S. Pat. No. 4,996,924 which application was a continuation of U.S. patent application Ser. No. 07/084,289, filed Aug. 11, 1987 (now abandoned), which application was a continuation-in-part of U.S. patent application Ser. No. 829,946, filed Feb. 18, 1986 (now abandoned).

BACKGROUND OF THE INVENTION

The present McClain effect invention pertains to projectiles having improved in-flight performance. More particularly, the invention concerns projectiles with surface and subsurface aerodynamical characteristics which induce self-stabilizing spinning action and reduce drag effects, with attendant improvements in kinetic energies, range, accuracy and flight stability. Projectiles benefiting from the invention include ballistic missiles, small arms projectiles and explosive shells, artillery shells, shot pellets, and the like. The invention has application to projectiles fired into all forms of fluid, propelled in any manner and at all velocities.

Stone projectiles were first fired via catapults, which advanced after the Chinese invention of gun powder to stone spheres propelled by primitive explosive gases in smooth bore launch tubes. Later additions to projectiles were brass, iron and bronze spheres. The advent of the United States Civil War brought into being the rifled bore launch tube, and the rifling generated spin which materially improved range and quite possibly the kinetic impact energy of projectiles. Most modern day projectiles of streamline shape are launched via rifled bores, propelled by nitrocellulose gases at about 2700° C. and 14,000 times expansion into gases by volume of the nitrocellulose.

Projectiles fired from launch tubes having rifled bore generally have greater accuracy and range over similar projectiles fired from smooth bore launch tubes. The rifling in the bore imposes a spin on projectiles traveling through the launch tube. As a spinning projectile (i.e., rotating about its longitudinal axis) travels through the air, the spinning action tends to reduce the effects of drag and compression waves to slow the forward velocity and the rotation of the projectile. The present invention with its surface aerodynamical design characteristics acts to extend these advantages to projectiles fired from smooth bore launch tubes. It is to be noted, however, that the invention also has application to projectiles fired from rifled bores. In general, the projectiles of the invention have increased velocity, accuracy, and longer ranges, while retaining kinetic energies, over similar projectiles which do not incorporate the invention.

Projectiles which are spin stabilized achieve a high rate of rotation as the projectiles travel over their trajectories. Such rotation may range between about 300 and about 2,000 radians per second. These high rotation speeds for known smooth-surface projectiles generally are imparted by conventional projectile driving bands which extend around the exterior circumference of such projectiles. The bands engage rifling in launch tubes as the projectiles are fired through the tubes.

As noted above, projectiles fired from smooth launch tubes generally lack the velocity, kinetic energies, range and accuracy of smooth projectiles fred from rifled barrels. In the past a number of efforts have been made to modify the projectiles fired from smooth launch tubes; however, these modifications have failed to bring about the desired amounts of improvement. The modifications have included the installation of such features as fins and dimples on the exterior surface. While some improvements have been realized by such features, much more improvement remains to be obtained.

SUMMARY OF THE INVENTION

The present invention provides projectiles which induce their own spinning action and are thereby especially valuable for use in smooth bore launch tubes. The spin self-stabilizes the projectiles by taking into account such factors as boundary layer effects, drag effects, compression, bow, shock waves, Bernoulli effects, velocity, electromagnetic effects and molecular friction/-pressure/temperature effects.

The teachings of the present invention provide projectiles which are self-stabilizing and spin stabilized while in high velocity flight. According to the invention, the exterior surface of the projectiles defines a plurality of grooves and lands. These grooves and lands preferably extend substantially over the entire surface of a projectile from its tip to its base. The projectile, fired from a launch tube, travels at a high rate of velocity. The fluid pressure reacting on the lands and grooves at high velocities imparts a spin or rotation on the projectile. The rate of spin is determined in large part by the molecular density of the fluid, the velocity of the projectile and the angle of attack for the surface expressions and/or subsurface impressions. The rate of spin may be varied by changing or modifying the number and nature of the surface expressions and/or subsurface impressions. Air flow over the projectiles creates a smooth laminar boundary layer effect around the projectiles, which results in a significant reduction of drag. The rotation of the projectiles affects the degree of lift and height and trajectory. Projectiles of the present invention have an increased range, accuracy, height of trajectory and retention of kinetic energies.

The present invention comprises projectiles which are circular in transverse section and sized to fit within the bore of a launch tube. The projectiles in longitudinal sections through the longitudinal axis should have an outer edge or boundary which imparts a streamline effect to the projectile. Thus, a longitudinal section may be cylindrical with a pointed or curved nose with a square tail, a pointed tail, a curved tail, a boat tail or the like, as claimed in the parent application, or a longitudinal section may also be circular, elliptical, ovoid, tear-shaped, etc. If elliptical, it is preferred that the major axis of ellipsis coincide with the longitudinal axis of the projectile. As claimed in this application, the projectile may also have a nose cone section and a body section that rotate relative to one another through use of different surface deviations on the sections.

It is apparent, then, that a projectile as brought out herein may involve a wide range of solid shapes including spheres, spheroids, prolate spheroids, ellipsoids, and cylinders with conoid noses, paraboloid noses, hyperboloid noses, spherical noses, etc.

It is a particular feature of the invention that a projectile of the types described above have an outer aerodynamic surface which is configured to impart a self-stabilizing spin to portions, or sections, of the projectile about its longitudinal axis. In general, substantially the entire longitudinal surface of the sections of the projectile should be provided with spaced grooves and lands which extend around the projectile in a path which is essentially circular when viewed from either end of the projectile. Thus, as shown by the Specification, the grooves or lands may be circular or parallel to one another, or they may be spiral along the projectile in a helical or spiral manner. In any case, the grooves or lands should preferably be present along the entire length of the section of the projectile. Thus, the grooves or lands should preferably extend from the nose or the point of each section of the projectile back along the lateral surface of the projectile toward the tail of the projectile. The lands should preferably be wide enough to provide an adequate bearing surface relative to the interior of the launch tube. The lands and grooves are substantially constant in width along their length. Fin- or vane-like members are generally to be avoided.

If desired, small depressions in the form of round, oval, or polygonal dimples may be formed in the surface of a projectile, as shown herein, between the grooves or between the lands. Similarly, raised dimples or pimples may be formed n the projectile surface, preferably between the lands.

As also brought out herein, the design of any specific projectile of the invention will depend upon the purposes of the projectile. For example, a projectile intended for high speed will normally have a pointed nose. A long range projectile should normally have a high spin rate and therefore relatively numerous grooves and lands with a relatively great angle of spiral. Spin rates also tend to promote greater height of trajectory, range and kinetic energy. Dimples help to reduce drag effects, and depending on depth and size, influence trajectory.

The projectiles of the invention may be solid or they may be hollow to carry loads of explosives and/or propellants. Similarly, the projectiles of the invention may, themselves, be loaded in a shell for dispersion after the shell has been launched. Thus, as brought out herein, spherical or other geometric shapes of solid shot may be loaded in a shot shell and fired from the shot shell. Particularly effective shot designs are those wherein the shot are tear-shaped, ellipsoidal, or cylindrical with pointed ends.

With the foregoing and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 illustrates a tear-drop-shaped shot pellet which may be fired through a launch tube with other such pellets in a shot shell.

FIG. 2 illustrates a streamline ellipsoid shot pellet which may be fired through a launch tube with other such pellets in a shot shell.

FIG. 3 illustrates an elongated streamline prolate ellipsoid similar to FIG. 2, but having ovoid depressions in the helical groove surface.

FIG. 4A is a side view of a spherical shot pellet with latitudinal circumspherical ridges protruding from the surface to define circumspherically sloped grooves between adjacent ridges.

FIG. 4B is a top view of the spherical shot pellet illustrated in FIG. 4A.

FIG. 5 is a cut-away partial view of a spherical shot pellet illustrated in FIG. 4A having circular depressions in the sloped groove surface between the lands in the pellet surface.

DESCRIPTION OF THE INVENTION

Figure 6:
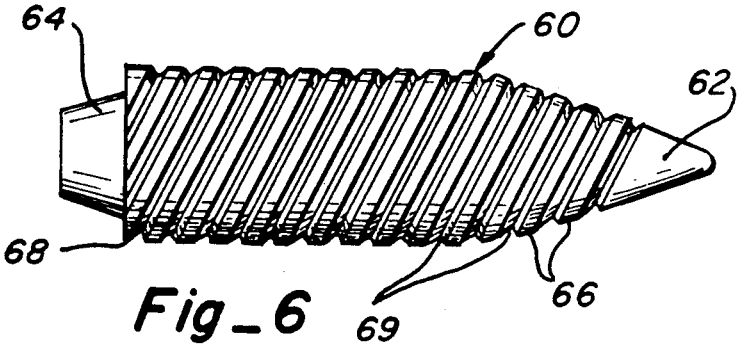
FIG. 6 illustrates a longitudinal cylindrical projectile having a paraboloid nose and a boat-tail end with helicoidal grooves in the surface of the projectile.

With reference to the drawings, various preferred embodiments of the present invention will be more readily understood when considered together with this written description.

The invention provides a variety of designs for molecular friction/pressure reaction control surfaces for projectiles which materially enhance the aerodynamic flight characteristics of the surface of the projectile. In most embodiments shown herein, these friction/pressure/temperature reaction surfaces preferably include helical grooves spiraling on the projectile surface around its longitudinal axis. In some embodiments circular grooves and lands disposed latitudinally around the longitudinal axis are preferred. Surface depressions or protrusions having circular, ovoid, or polygonal shapes may be provided between the lands and grooves.

Turning to FIG. 1 there is shown a side view of a teardrop-shaped shot pellet 10 having a spherical forward portion 12 on a conical tail 14 with a continuous helical groove which defines defining a continuous helical land 16 and groove 18 in the surface of the projectile 10. The groove 16 and land 18 are placed at an angle oblique to the longitudinal axis of shot pellet 10 (and hence is also placed at an acute angle to the longitudinal axis when measured with respect to the side of the longitudinal axis extending in the opposite direction used to indicate placement at an oblique angle).

FIG. 2 illustrates an ellipsoid or spheroid shot pellet 20. The projectile 20 approximates the shape of a football, and, like the pellet 10 of FIG. 1, includes a continuous helical groove which defines a continuous spiraling groove depression 24 and land 22 in the surface of the projectile 20.

FIG. 3 illustrates an alternate embodiment of the ellipsoid shown in FIG. 2. The shot pellet 30 comprises an elongated ellipsoid, and includes a continuous groove 34 in which is defined a series of subsurface impression or depressions 35 between a continuing land 32 in the surface of pellet 30. As partially illustrated in this embodiment the subsurface impressions or depressions 35 may be ovoid impressions spaced uniformly in the groove surfaces of the pellet 30. These ovoid impressions 35 are uniformly distributed and provide to the shot pellet 30 lift, or height of trajectory, to substantially increase the range or the distance of the pellet 30 over a similar pellet without such depressions. A preferred embodiment uses ovoid-shaped depressions, but circular, spherical, or polygonal-shaped depressions may be gainfully employed as well. An alternate embodiment useful in such shot pellets uses ovoid or other shaped surface expressions or projections in the surface of the groove 34 and/or land 32 instead of the depressions 35. Still another embodiment of the shot pellet 30 includes only continuous groove 34 and land 32, which spiral on the surface of the projectile around its longitudinal axis.

FIGS. 4A and 4B illustrate an improved spherical shot for use in shot shells. The spherical pellet 40 includes a uniformly spaced series of circumspherical projections 42 and/or grooves which defined latitudinal lands or ledges on the sphere surface.

FIG. 5 is a cut-away partial view of a spherical shot pellet such as that illustrated in FIG. 4A. The cut-away illustrates uniformly spaced latitudinally disposed circular or ovoid depressions 46 in the sloped grooved surface between the lands 42 in the surface of the pellet 40. These depressions 46 are thus placed in the curved sphere wall between the horizontal ledges 42 of the pellet 40.

The surface expressions shown herein defined by the helical grooves or the projections described above may also be applied to elongated projectiles fired from a variety of launch tubes such as pistols, rifles, artillery, rockets and the like. Alternate embodiments may encompass self-contained motors for propulsion and may thus eliminate the necessity for a launch tube. FIG. 6 illustrates an elongated cylindrical projectile 60 having a parabolid nose 62 and a boat-tail end 64. A series of helical surfaces or lands 66 extend at an oblique angle around the outer circumference of the projectile 60 from the nose cone 62 to the base 68 of the projectile 60. These raised surfaces 66 are separated by adjacent grooves 69.

Figure 7:
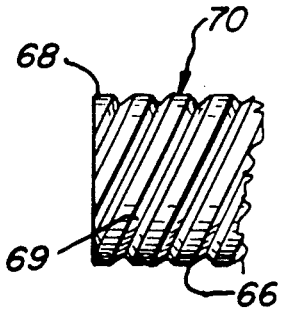
FIG. 7 is a cut-away partial view of a projectile illustrated in FIG. 6, having a squared end.

Turning to FIG. 7, there is illustrated an alternate embodiment of the longitudinal projectile 60 illustrated in FIG. 6. The illustrated projectile 70 eliminates the boat-tail 64 from the butt end 68 to terminate in a blunt end. When viewed on end, the cross-section of the butt end 68 is circular. The surface of the illustrated projectile 70, however, includes the uniformly spaced helispherical raised molecular reaction surfaces defined by the grooves and lands described above.

Figure 8:
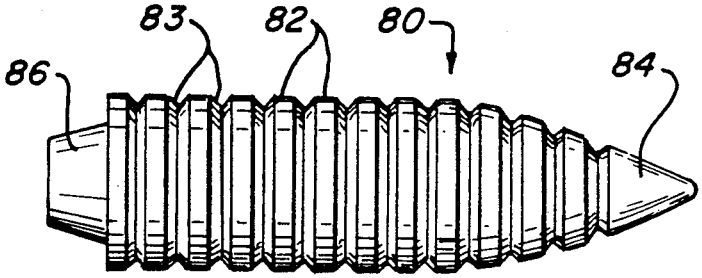
FIG. 8 illustrates an elongated cylindrical projectile having a parabolid nose and a boat-tail end with circular grooves extending latitudinally around the circumference of the projectile.

FIG. 8 illustrates a special embodiment of an elongated cylindrical shell similar to that illustrated in FIG. 6. As with the projectile 60 in FIG. 6, the projectile 80 includes a paraboloid nose 84 and a blunt tail 86. The exterior surface of the illustrated projectile 80 includes a series of circumspherical raised projections 82. These projections define V-shaped grooves 83 in the streamline surface of the projectile 80. The grooves are preferably symmetrical in transverse section. An alternate embodiment may have a square-U shaped groove having a uniform width and depth in the projectile surface for smooth laminar boundary layer effect at low velocities.

Figure 9:
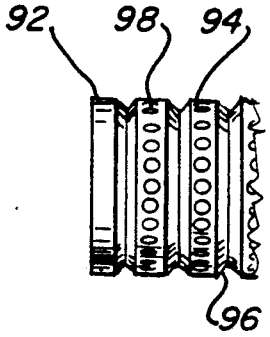
FIG. 9 illustrates an elongated cylindrical projectile similar to that illustrated in FIG. 8, having circular grooves extending latitudinally around the circumference of the projectile and a series of spaced depressions in the grooved surface of the projectile.

FIG. 9 illustrates an alternate embodiment of the longitudinal cylindrical projectile 80. This embodiment has a blunt butt end 92, and the raised circular projections or lands 94 define a series of grooves 96 in the surface of the projectile 90. Ovoid depressions 98 are equally spaced around the circumference of the projectile 90 in the grooves 96 between the lands 94.

Figure 10:
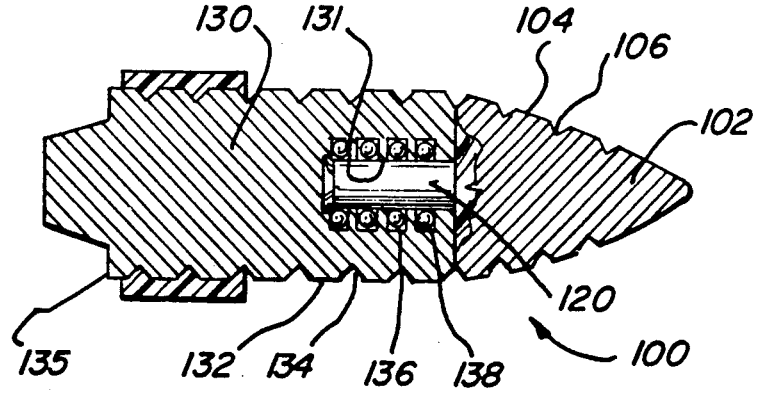
FIG. 10 illustrates in cross-section a counter-rotating nose cone projectile.

FIG. 10 illustrates the invention claimed in this application and shown, in cross section, a self-stabilized spin projectile 100 which may be fired from a launch tube. A conical nose cone 102 includes a plurality of helical lands 104 and subsurface grooves 106 extending counter-clockwise from the tip of the nose cone 102 substantially to its base. As shown in the drawings, lands 104 and grooves 106 extend at an acute angle with respect to the longitudinal axis of nose cone 102. A connector shaft 120 secured to the base of the nose cone 102 has a projecting end that flares outwardly, as shown in FIG. 10, so that shaft 120 projects beyond the base along the longitudinal axis of the projectile 100 and is journalled in the rear cylindrical main projectile body or tube 130. The body 130 includes a longitudinal bore 131 adapted to receive the projecting connector 120. The exterior surface of the projectile main body 130 has a plurality of helical raised lands 132 and subsurface grooves 134 which extend clockwise from the front of the body 130 to its butt end 135. As shown in the drawings, lands 132 and grooves 134 extend at an acute angle with respect to the longitudinal axis of body 130. The connector shaft 120 is connected to the nose cone 102 and the main body 130 in a manner to enable the nose cone 102 to rotate relative to the body 130. Ball bearings 136 in races 138 disposed in the bore 131 extend around the circumference of the connector shaft 120. The connector 120 rolls on the bearings 136 and permits the nose cone 102 to rotate relative to the body 130. However, any friction reduction agent may be used in lieu of or to supplement the ball bearings 136.

Figure 11:
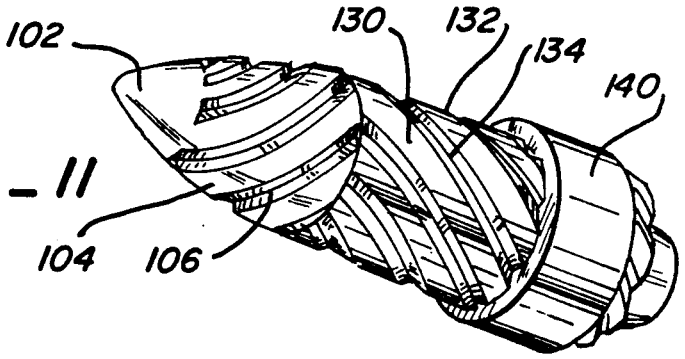
FIG. 11 is an orthographic view of the counter-rotating nose cone projectile illustrated in FIG. 10.

FIG. 11 is an orthographic view of the counter-rotating nose cone projectile illustrated in FIG. 10 and adapted for use in rifled launch tubes. An o-ring gas seal 140 surrounds the exterior circumference of the tube 130 and is designed to engage the rifling in the launch tube. An alternate embodiment of the counter-rotating projectile may be adapted to contain a motor so that the projectile is self-propelled. That embodiment discards the o-ring 140.

The various surface expressions of the present invention may be incorporated into generally cylindrical projectiles to permit the projectiles to attain self-stabilizing ballistic spin, increased trajectory and range, increased accuracy of flight, and retention of kinetic energies. The spin stabilization of the projectile eliminates the wobble and tumble associated with the projectiles traveling through a fluid. Helical lands or grooves are generally preferred in the exterior surface of the projectiles. The lands are separated by grooves which extend into the subsurface of the projectile. It is generally preferred that the surface have one or more helical grooves which encircle the projectile substantially over its length. The angle at which the grooves cross the longitudinal axis of the projectile is the angle of attack, and it is preferred that this angle of attack be oblique with respect to the axis. For embodiments shown herein having closely spaced grooving, a second, or more, additional continuous helical groove may be necessary.

Generally, projectiles traveling at high velocity and high altitudes will have fewer, shallower surface grooves with a low angle of attack. The grooves are helispherical, but in such high speed, low fluid density applications may make less than one revolution around the projectile. As a projectile travels through a fluid, such as the atmosphere, the fluid impacts on the groove and land surface expression and deflects. The impact induces a rotational spin on the projectile about it longitudinal axis. This spin stabilizes the projectile to travel more accurately along its trajectory. Such stabilized travel further reduces drag effects on the projectile and results in increased range and in a higher amount of kinetic energy delivered to a target. The angle of attack of the aerodynamic air foil surfaces is determined by the projectile velocity and fluid density.

Projectiles moving at a relatively slow speed, i.e., about mach 1 or less, and in a relatively dense fluid, such as the atmosphere close to the ground, will need larger and a greater frequency of surface expressions necessary to engage the molecules to induce a self-stabilizing spin on the projectile and/or a smooth laminar boundary layer fluid flow.

For relatively slow moving projectiles traveling in less dense fluids, the surface expressions have to be highly enhanced and enlarged because there are less molecules in the fluid to induce spin. However, increasing speed permits decreasing the spiral helical grooving and surface ridges required to engage the thinner fluid to induce spin.

Thus, the speed of a projectile and the density of the fluid through which it travels determines the amount of grooving and size of the surface expressions and/or subsurface impressions necessary to induce self-stabilized ballistic spin and to minimize drag effects.

The slope of the impact surface of the groove or surface expression impacted by the fluid through which the projectile travels may be varied as well. It is generally preferred that the impact surface of the surface expressions be perpendicular with respect to the longitudinal axis of the projectile. This slope angle may however, be acute such that the surface expression inclines forward or backward with respect to the projectile axis.

Projectiles of all types, including shot pellets, bullets, shells, artillery shells, and rockets may apply the teachings shown herein. Projectiles incorporating the features of the invention, which are fired from launch tubes are preferably fired from smooth bore launch tubes. Rifled launch tubes may be used as well; however, the projectile then needs to include an o-ring gas seal around the circumference of the projectile to engage the rifling on the interior of the launch tube. Such an embodiment will generally attain a self-stabilized spin more rapidly than an embodiment fired from a smooth bore launch tube. Such o-rings may be made of Teflon or other suitable plastics, or any friction reducing metal.

The illustrated shot pellets of FIG. 1 through 5 may be manufacture by machining, impression molding, casting, swaging, wire extrusion and punching or other processes well known in the art. These pellets may be included in a shot shell such as that fired from a shotgun. The lands and grooves defined in the surface of the shot promote laminar flow of fluid, e.g., air molecules, over the surface and decrease the turbulent drag vacuum flow behind the shot. This reduces the difference in pressure on the forward nose of the shot and the back pressure pulling on the butt end of the shot. The reduced differential pressure decreases drag and thus the shot travels through the fluid atmosphere towards its target at a high velocity for a longer period of time. With lower drag, the forward kinetic force delivered by the shot is greater over this longer range. Thus, the effective useful distance of such shot is greater than for previously used smooth surface shot.

The shot pellets illustrated in FIGS. 1 through 5 attain spin when fired. The groove surface of the pellets in FIGURES 1 through 3 induces a rotational spin around the pellet's longitudinal axis. The pellets shown in FIGS. 4A, 4B, and 5 spin on axis parallel to the grooves. In all cases the spin promotes flow of the fluid molecules around and past the pellets traveling through the air towards a target. Increased smooth laminar flow of fluid reduces drag on the pellet over that of a smooth surfaced pellet. This reduction in drag forces permits the pellet to retain to a greater extent its forward kinetic energy. Thus, shot pellets shown herein will be traveling faster and more accurately along the trajectory towards a target than previously known smooth surface shot. This results in shot having greater accuracy, greater range, and capable of delivering to a target a higher level of kinetic impact energy. For instance, ordinary steel shot used for duck hunting has an effective kill range of about 30 yards. Like shot of the present invention however, has effective kill range in excess of about 250 yards.

Turning now to FIG. 10, which illustrates the invention claimed in this application, the projectile 100 may be adapted to be fired from a launch tube or be a stand alone launch. As is conventional, a firing base may be connected to the rear of the body of the projectile. As the projectile 100 is traveling through the atmosphere (or other fluid into which it is fired), the fluid molecules impact the helical raised lands 104 which extend counterclockwise from the tip of the nose cone 102 to its base. This impact induces a clockwise rotation on the nose cone 102. The connector shaft 120 which projects beyond the base of the nose cone 102 also rotates in a clockwise direction. The ball bearings 136 in the races 138 which extend around the circumference of the connector shaft 120 permit relative rotational movement between the nose cone 102 and the projectile tube 130. The exterior surface of the tube 130 has helical raised lands 132 which extend clockwise from the front to the rear of the tube 130. The molecules of air impacting the lands 132 induce a counterclockwise spin on this rear portion of the projectile 130. Thus, as the projectile travels through the fluid, the front of the projectile is spinning in a clockwise direction while the rear of the projectile is spinning in a counterclockwise direction. The counter-rotating nose cone projectile according to the invention eliminates to a substantial degree the compression bow or shock wave which is in front of and travels along the exterior surface of the projectile. It appears this reduction of bow pressure in the boundary layer of fluid surrounding the projectile enhances a smooth laminar flow of fluid around the projectile. This reduces the back drag effects on the rear of the projectile, the turbulent drag effects along the side of the projectile, and the compression and shock waves on the forward end of the projectile.

The counter-rotating projectile illustrated in FIG. 10 may be fired from either a rifled or a smooth launch tube. In each instance an o-ring or other suitable gas seal 140 is normally installed on the projectile. In a rifled tube, the gas seal engages the rifling; and while the projectile travels through the launch tube, an initial rotation is imparted to the projectile. In any case, once the projectile clears the muzzle of the launch tube, the gas seal falls away. Fluid pressures on the lands 104 and grooves 106 of the nose cone 102 impart a counter-rotation to the nose cone. The rotating tube 130 and counter-rotating nose cone 102 stabilize the projectile 100 on its trajectory towards its target. An alternate embodiment of the counter-rotating nose cone projectile has a self-contained motor in the main body 130 of the projectile. This permits the projectile to be launched directly without having to travel through a launch tube.

The synergistic combination of the molecular friction/pressure/temperature reaction surfaces and boundary layer effects defined by the surface expressions and subsurface impressions, work together to stabilize and establish spin or rotation of a projectile around its longitudinal axis. This increases the kinetic energy of the projectile on the target; it also increases velocity, range and height of trajectory. The subsurface impressions and surface expressions as taught in this invention may be incorporated into standard projectiles without decreasing the throw weight of the projectile or increasing the amount of propellant necessary to launch the projectile.

As illustrated in FIGS. 3, 5 and 9, alternate embodiments of projectiles having the molecular reaction/-pressure friction surfaces, as shown herein, may further include shallow depressions and/or shallow projections. These depressions and projections may taken on a variety of geometric shapes. However, it is preferred that the depressions and projections be semi-spherical or ovoid depressions or projections placed in the groove surface between the lands in the surface of the projectile. It is contemplated that large shallow dimples reduce drag, increase lift, and create high and long trajectories. Small, deep dimples control lift, decrease drag and produce lower flight paths. The projections however contribute to the stabilizing spin of projectiles.

The principles, preferred embodiments and modes of operation of the present invention have been described in this specification. The invention is not to be construed as limited to the particular forms disclosed, since these are regarded as illustrated rather than restricted. It will be recognized, for example, that the helical lands and grooves of the several forms of elongated projectiles of the invention may vary in width and/or depth along their length. Thus, several helical lands may start at the nose end of a projectile and widen as they leave the nose end. If the tail end is also pointed, as in the projectile of FIG. 2, the lands may narrow as they approach the tail end. In any case, it is generally preferred that the lands and grooves be symmetrical when viewed in their respective transverse sections.

The projectiles described herein which employ helicoidal lands and grooves have lands and grooves which make at least one revolution around the projectiles. In many instances fractional revolutions are also contemplated, especially for high speed projectiles at high altitudes.

Further variations and changes may be made by those skilled in the art without departing from the spirit of the invention as described by the following claims.

What is claimed is:

1. A projectile, comprising:

a nose section having an outer surface with a plurality of spaced deviations thereon extending at least partially around said nose section outer surface to thereby provide alternate lands and grooves on said nose section outer surface;

a body section having an outer surface with a plurality of spaced deviations thereon extending at least partially around said body section outer surface to thereby provide alternate lands and grooves on said body section outer surface, said lands and grooves on said outer surface of said body section and said lands and grooves on said outer surface of said nose section extending in opposite directions with respect to the longitudinal axis of said projectile; and connecting means for connecting said nose section and said body section so that one of said sections is rotatable with respect to the other of said sections.

2. The projectile of claim 1 wherein said lands and grooves on said outer surfaces of said nose section and said body section extend helically around said outer surfaces.

3. The projectile of claim 1 wherein said lands and grooves on said outer surface of said nose section extend counterclockwise toward said body section, and wherein said lands and grooves on said outer surface of said body section extend clockwise away from said nose section.

4. The projectile of claim 1 wherein said connecting means includes a shaft extending from one of said sections and a bore formed in the other of said sections to receive said shaft whereby said sections are rotatable with respect to one another.

5. The projectile of claim 1 wherein said nose section and said body section have a circular cross-section normal to the longitudinal axis of each of said nose section and said body section.

6. The projectile of claim 5 wherein said lands and grooves on said nose section and said body section are at an acute angle with respect to said longitudinal axis of said nose section and said body section.

7. The projectile of claim 1 wherein said outer surface of said nose section is conical and the outer surface of said body section is cylindrical and provides a streamline outer contour for said projectile.

8. The projectile of claim 1 wherein said body section has a gas seal thereon.

9. A self-stabilized spin projectile to be fired from a launch tube, comprising:

a nose cone having a plurality of helical lands and grooves extending counterclockwise from the tip to the base of the nose cone;

a connector shaft projecting beyond the base of the nose cone along the longitudinal axis of the nose cone;

a cylindrical projectile body having a longitudinal bore to receive the projecting connector shaft, the exterior surface of the body having a plurality of helical lands and grooves extending clockwise from the front to the rear of the body; and said shaft connected to said nose cone and said body so that the nose cone and the body can rotate relative to one another.

10. A self-stabilized spin projectile as recited in claim 9 further comprising a gas seal extending around the exterior circumference of the body.

11. A self-stabilized spin projectile as recited in claim 9 further comprising a bearing which connects the shaft with the body to enable the nose cone to rotate relative to the body.

12. A self-stabilized spin projectile as recited in claim 9 wherein a projecting end of the shaft flares outwardly.

* * * * *